United States Patent [19]

Hunter

[11] Patent Number: 5,069,268

[45] Date of Patent: Dec. 3, 1991

[54] BASIN FORMER FOR A MATCHPLATE MOLDING MACHINE

[75] Inventor: William A. Hunter, Naples, Fla.

[73] Assignee: Hunter Automated Machinery Corporation, Schaumburg, Ill.

[21] Appl. No.: 667,268

[22] Filed: Mar. 11, 1991

[51] Int. Cl.[5] ..... B22C 15/02; B22C 23/00

[52] U.S. Cl. ..... 164/158; 164/182; 164/187; 164/239; 164/242; 164/244

[58] Field of Search ..... 164/187, 182, 162, 158, 164/235-244

[56] References Cited

U.S. PATENT DOCUMENTS

| | | | |
|---|---|---|---|
| 2,275,806 | 3/1942 | Perazo | 164/162 |
| 3,234,602 | 2/1966 | Hunter et al. | 164/244 X |
| 3,970,138 | 7/1976 | Bührer | 164/244 |

FOREIGN PATENT DOCUMENTS

| | | | |
|---|---|---|---|
| 50-38057 | 12/1975 | Japan | 164/244 |
| 240948 | 9/1969 | U.S.S.R. | 164/244 |
| 546423 | 4/1977 | U.S.S.R. | 164/244 |
| 554059 | 7/1977 | U.S.S.R. | 164/244 |

*Primary Examiner*—J. Reed Batten, Jr.

*Attorney, Agent, or Firm*—Leydig, Voit & Mayer, Ltd.

[57] ABSTRACT

A basin former on a squeeze plate coacts with a sprue former on a pattern plate to form a pouring basin and a sprue in a sand mold. Sand which enters the basin former during formation of the pouring basin is ejected upwardly therefrom by pressurized air which is introduced into the basin former through an opening in the side of a plastic liner located in the basin former. The squeeze plate is modular in nature in that the basin former may be attached to the squeeze plate at any selected one of several locations without need of disconnecting and re-connecting the source of pressurized air when the position of the basin former is changed.

8 Claims, 3 Drawing Sheets

BASIN FORMER FOR A MATCHPLATE MOLDING MACHINE

BACKGROUND OF THE INVENTION

This invention relates to a molding machine and more particularly to an automatic matchplate molding machine of the type in which a pattern plate is located between cope and drag flasks adapted to be filled with sand and adapted to be rammed upwardly toward a squeeze head in order to pack the sand and form cope and drag molds in the cope and drag flasks, respectively. A machine of this general type is disclosed in Hunter U.S. Pat. No. 4,840,218.

The pattern plate of such a machine carries an upwardly projecting sprue former which forms a sprue in the cope mold. Coacting with the sprue former is a basin former which creates a pouring basin in the upper side of the cope mold around the sprue. The basin former is carried by the squeeze head and telescopically receives the sprue former when the cope flask and the pattern plate are rammed upwardly toward the squeeze head. When the two formers are telescoped together, a small sand core may be created in the basin former and may fall downwardly into the pouring basin and the sprue when the cope flask and the cope mold are retracted downwardly from the squeeze head. During such retraction, a vacuum is created between the cope mold and the squeeze head and tends to draw loose sand across the top of the mold toward the pouring basin.

SUMMARY OF THE INVENTION

The general aim of the present invention is to provide a molding machine of the above general type having new and improved means for removing sand from the basin former after the sprue and the basin have been created and before the cope mold is retracted downwardly from the basin former.

A more detailed object of the invention is to achieve the foregoing by injecting a blast of pressurized air through the side of a liner in the basin former in order to blow sand in the basin former out of the upper end thereof and away from the mold.

Still another object of the invention is to provide a squeeze head having a squeeze plate for supporting a basin former at any selected one of a plurality of locations and having the capability of directing pressurized air to the basin former at any selected location without need of establishing an air connection to the basin former each time its location is changed and without need of complex valving.

The invention also resides in the unique provision of air passages in the upper end of the basin former for blowing loose sand outwardly off of the top of the cope mold and away from the basin prior to and during retraction of the cope mold from the squeeze head.

These and other objects and advantages of the invention will become more apparent from the following detailed description when taken in conjunction with the accompanying drawings.

DETAILED DESCRIPTION OF THE PREFERRED EMBODIMENT

Figure 1:
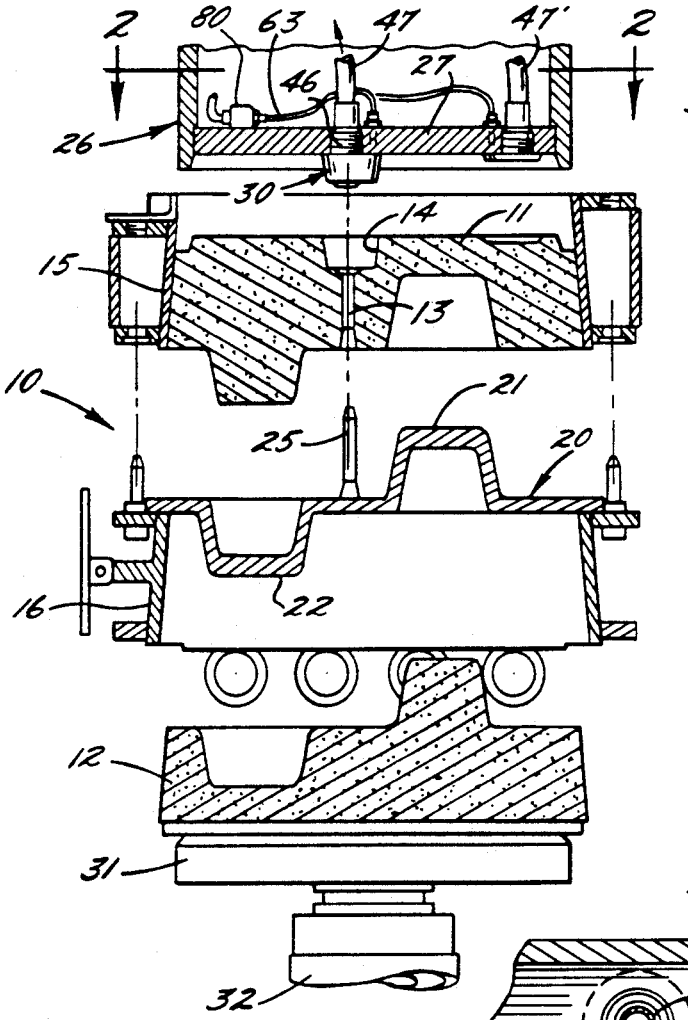
FIG. 1 is a somewhat schematic vertical cross-sectional view of the squeeze heads, the molding flasks and the pattern plate of a new and improved matchplate molding machine incorporating the unique features of the present invention.

For purposes of illustration, the invention has been shown in the drawings as embodied in a matchplate molding machine 10 for making green sand molds of the type used by foundries to form metal castings. An overall mold typically includes an upper cope mold 11 and a lower drag mold 12 which eventually abut one another to define a cavity having the shape of the part to be cast. Molten metal is introduced into the cavity through a vertically extending sprue 13 formed in the cope mold. To facilitate pouring of the metal into the sprue 13, an enlarged pouring basin 14 is formed in the upper side of the cope mold adjacent the upper end of the sprue.

The machine 10 includes cope and drag flasks 15 and 16 in which the cope and drag molds 11 and 12, respectively, are formed. A pattern plate or matchplate 20 is adapted to be located between the flasks 15 and 16 and carries cope and drag patterns 21 and 22 which coact to form the cavity in the ultimate mold. The upper side of the matchplate 20 carries a vertically extending sprue former 25 which is in the form of an elongated plastic finger and which effects formation of the sprue 13 in the cope mold 11.

Located above the cope flask 15 is a vertically fixed squeeze head 26 having a lower horizontal squeeze plate 27 whose lower side carries a basin former 30. The latter is aligned vertically with the sprue former 25 and serves to create the pour basin 14 in the upper site of the cope mold 11.

FIG. 1 shows the various components of the machine 10 in the positions such components occupy after the cope and drag molds 11 and 12 have been formed and just after the molds have been separated from the matchplate 20. In this position, the drag mold 12 has been lowered from the drag flask 16 and rests on a lower squeeze head 31 which is adapted to be moved vertically by a reciprocating hydraulic actuator 32. Formation of the molds 11 and 12 is effected by filling the flasks 15 and 16 with sand and by moving the lower squeeze head 31 upwardly. As explained in detail in Hunter U.S. Pat. No. 4,840,218, the disclosure of which is incorporated herein by reference, this results in the sand in the drag flask 16 being compacted between the lower squeeze head 31 and the lower side of the matchplate 20 and results in the sand in the cope flask 15 being compacted between the upper side of the matchplate and the lower side of the squeeze plate 27 of the upper squeeze head 26.

Figure 3:
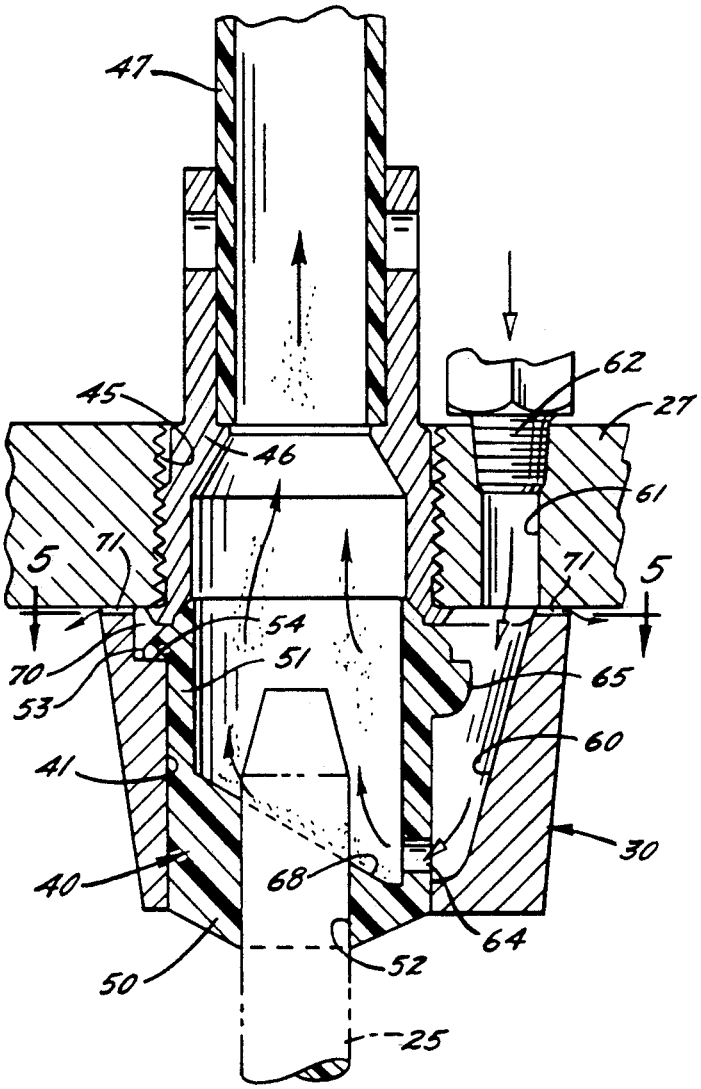
FIGS. 3 and 4 are enlarged fragmentary cross-sections taken substantially along the lines 3—3 and 4—4, respectively, of FIG. 2.

As the matchplate 20 moves upwardly toward the squeeze plate 27, the sprue former 25 telescopes into the basin former 30 (see FIG. 3). As a result, sand may be pushed upwardly from the cope flask 15 and into the basin former by the sprue former. In prior arrangements, the sand falls from the basin former and into the newly formed basin 14 and sprue 13 as the cope mold 11 and the matchplate 20 are drawn downwardly from the squeeze plate 27.

In accordance with one aspect of the present invention, sand is ejected upwardly out of the basin former 30 by pressurized air which is introduced into the basin former through the side of a unique liner 40 (FIGS. 3 and 8) located in the basin former and adapted to telescopically receive the sprue former 25. By virtue of blowing sand out of the basin former by means of air introduced through the liner, virtually no sand drops downwardly into the newly formed basin 14 when the sprue former is pulled downwardly out of the basin former.

Figure 4:
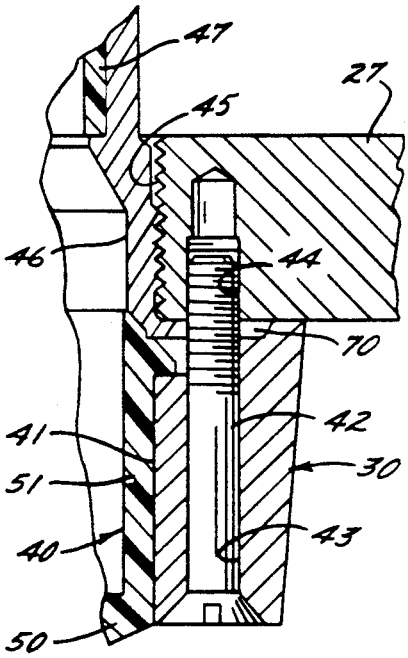
Figure 8:
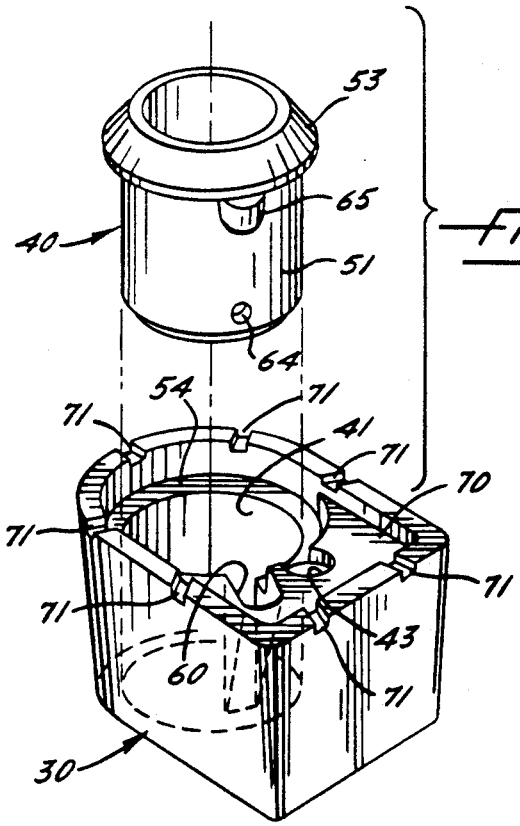
FIG. 8 is an exploded perspective view of the basin former.

More specifically, the basin former 30 herein is a cast metal member which is formed with a vertically extending and generally cylindrical passage or bore 41 (FIGS. 3 and 8). A screw 42 (FIG. 4) extends through a vertically extending hole 43 formed through the basin former adjacent one side of the bore 41 and is threaded into a tapped hole 44 formed in the lower side of the squeeze plate 27. The screw 42 clamps the basin former to the squeeze plate in a position in which the bore 41 is concentric with a threaded hole 45 (FIG. 3) formed vertically through the squeeze plate. A tubular fitting 46 is threaded into the hole 45 and its upper end receives a flexible sand discharge tube 47 which leads to a sand receptacle (not shown). Sand is blown out of the basin former 30 through the tube and is delivered to the sand receptacle.

The liner 40 is disposed in the bore 41 of the basin former 30 and is a tubular member which preferably is made of plastic. As shown in FIG. 3, the liner includes a bottom wall 50 and a vertically extending side wall 51. A vertical hole 52 is formed in the bottom wall 50 and is sized to telescopically receive the sprue former 25 with a snug but slidable fit. An annular collar 53 (FIG. 8) is formed around the upper end portion of the liner 40 and seats against a shoulder 54 defined in the basin former at the upper end of the bore. The collar tapers upwardly and seats against a complementary taper 55 (FIG. 3) formed in the lower end portion of the fitting 46 so as to establish a tight seal between the liner and the fitting.

Figure 2:
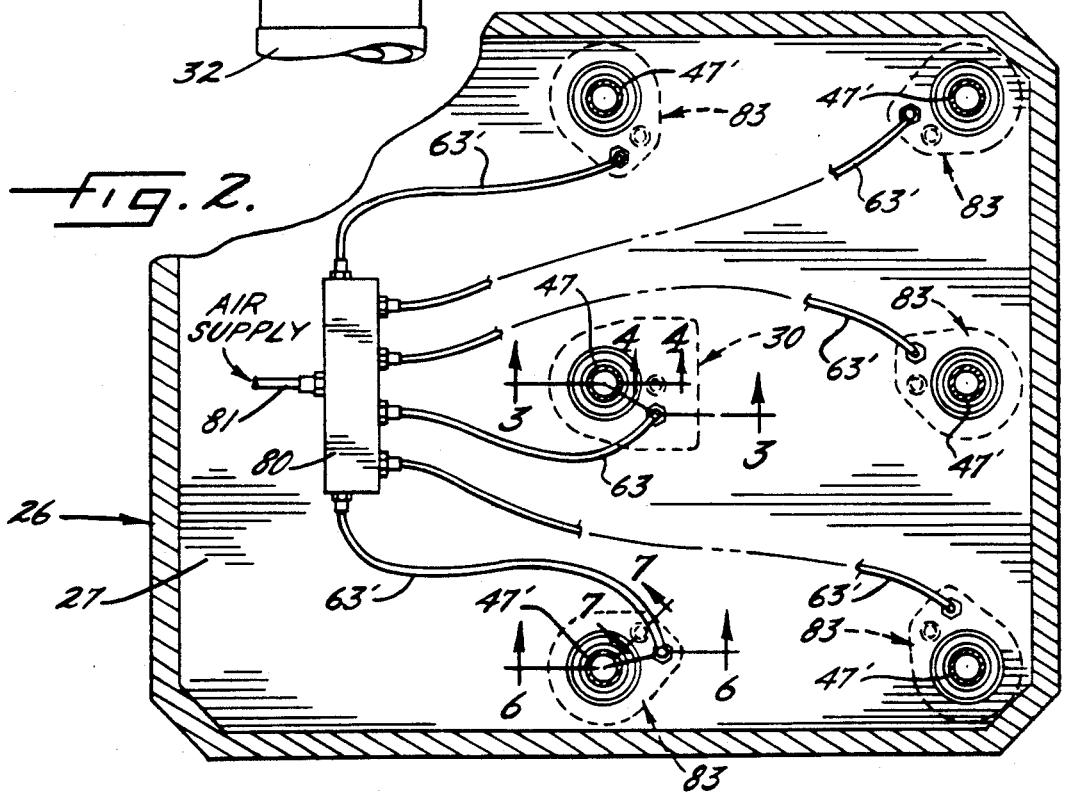
FIG. 2 is an enlarged fragmentary cross-section taken substantially along the line 2—2 of FIG. 1.

In carrying out the invention, a channel 60 (FIGS. 3 and 8) is formed in the basin former 30 and opens into one side of the bore 41. The channel is located outwardly of the liner 40 and its upper end communicates with a vertical hole or port 61 (FIG. 3) formed through the squeeze plate 27. A fitting 62 is threaded into the port 61 and is connected to a flexible line 63 (FIG. 2) which communicates with a source of pressurized air.

A radially extending opening 64 (FIGS. 3 and 8) is formed through the side wall 51 of the liner 40 near the bottom wall 50 thereof and communicates with the channel 60. To keep the opening 64 in circumferential alignment with the channel 60, an orienting lug 65 is formed integrally with the side wall 51 near the collar 53 and fits into the channel in order to hold the liner against rotation.

With the foregoing arrangement, pressurized air from the line 63 is admitted into the channel 60 via the port 61 and flows into the liner 40 through the opening 64. Sand pushed into the liner by the sprue former 25 is entrained in the air and is blown upwardly through the discharge tube 47. To help insure against sand being trapped in the corner at the junction of the bottom and side walls 50 and 51, the upper side 68 (FIG. 3) of the bottom wall is inclined so as to slope upwardly away from the opening 64. The slope of the upper side of the bottom wall causes the sand to be swept upwardly and to become entrained in the air stream.

Figure 5:
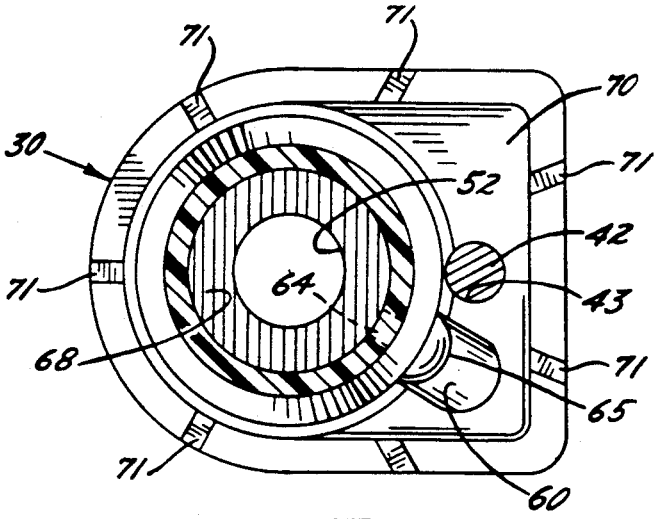
FIG. 5 is a cross-section taken substantially along the line 5—5 of FIG. 3.

Advantageously, a chamber 70 (FIGS. 3, 5 and 8) is defined in the upper end portion of the sprue former 30 above the bore 41 and communicates with the port 61. Several angularly spaced passageways 71 are formed in and open upwardly from the upper end of the basin former 30 and lead from the chamber 70 to the outer side of the basin former. When the port 61 is pressurized, air in the chamber 70 is discharged through the passageways 71 in the form of pressurized jets which sweep outwardly across the upper side of the cope mold 11 to clean loose sand therefrom and to prevent such sand from being drawn into the basin 14 by the vacuum which is inherently created when the cope mold is retracted downwardly from the basin former 30.

From the foregoing, it will be apparent that the present invention brings to the art a molding machine 10 with a new and improved basin former 30 in which sand is ejected upwardly by pressurized air injected through an opening 64 in the side of a liner 40. The plastic liner is relatively inexpensive and may be economically replaced when its lower wall 50 and hole 52 become worn due to repeated use.

According to a further aspect of the invention, provision is made to enable the basin former 30 to be attached to the squeeze plate 27 at any of several locations so that the basin former may be positioned to form a basin 14 in an area best suited for the particular cope mold 11 being formed. This aspect of the invention is particularly characterized by the fact that the location of the basin former may be changed quickly and easily and without need of disconnecting and then re-connecting the sand discharge tube 47 and the air line 63.

Figure 6:
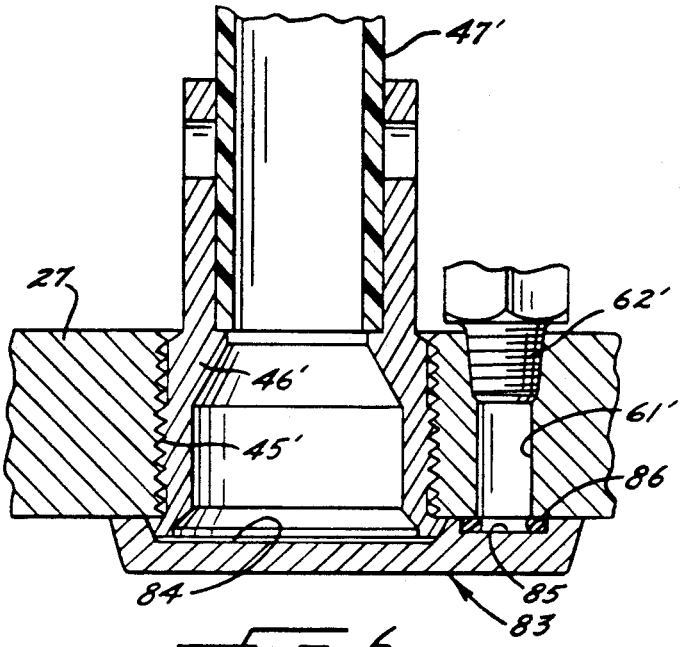
FIGS. 6 and 7 are enlarged fragmentary cross-sections taken substantially along the lines 6—6 and 7—7, respectively, of FIG. 2.

To achieve the foregoing, several tapped holes 45' (FIG. 6) identical to the hole 45 are formed through the squeeze plate 27 at spaced locations. A fitting 46 with a sand discharge tube 47' is threaded into each hole 45', these components being identical to the fitting 46 and the discharge tube 47, respectively. All of the discharge tubes 47' lead to the sand receptacle.

A vertical port 61' (FIG. 6) identical to the port 61 is formed through the squeeze plate 27 adjacent each hole 45' and receives a fitting 62' identical to the fitting 62. Air lines 63' (FIG. 2) connect the ports 61' to a manifold 80 located on top of the squeeze plate 27 and communicating with an air supply (i.e., the source of pressurized air) by way of a line 81. The air line 63 for the port 61 also communicates with the manifold.

Figure 7:
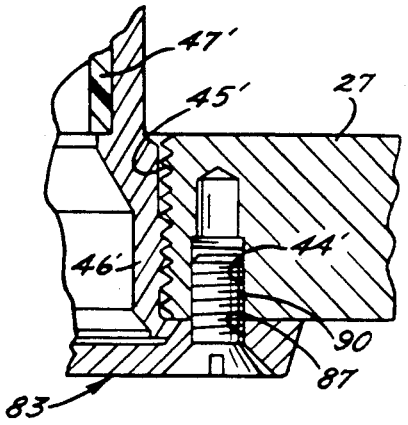
Figure 9:
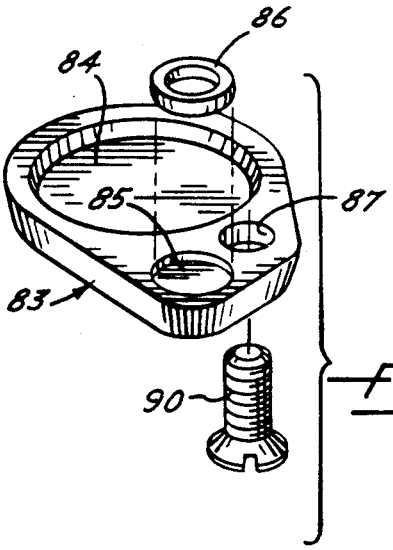
FIG. 9 is an exploded perspective view of a removable cover for the squeeze plate of the squeeze head.

When the squeeze plate 27 is set up with the basin former 30 located as shown in FIGS. 1 to 4, all of the other fittings 46' and air ports 61' are closed off. For this purpose, a cover plate 83 (FIGS. 6, 7 and 9) is attached to the underside of the squeeze plate 27 beneath each idle fitting 46' and air port 61'. As shown in FIG. 9, the upper side of each cover plate 83 is formed with a closed-end pocket 84 for receiving and sealing against the lower end of the fitting 46'. In addition, each cover plate is formed with a smaller closed-end pocket 85 adapted to receive an O-ring 86 for sealing the air port 61'. Finally, each cover plate is formed with a vertically extending hole 87 for receiving a screw 90. The latter is adapted to be threaded into a tapped hole 44' (FIG. 7)

formed through the squeeze plate 27 alongside the hole 45' and corresponding in function to the hole 44.

With the foregoing arrangement, the screws 90 are used to fasten the cover plates 83 to the lower side of the squeeze plate 27 at all locations except where the basin former 30 is actively positioned. Each cover plate closes off the associated fitting 46' while the O-ring 86 of each cover plate seals the air port 61'. Thus, when pressurized air is introduced to the manifold 80, all of the ports 61' are closed off so that air flows only through the air port 61 at the particular location of the basin former 30.

To change the position of the basin former 30, the latter is detached from the squeeze plate 27 by removing the screw 42 and, in addition, one of the cover plates 83 is detached by removing the associated screw 90. The basin former 30 then is re-attached to the squeeze plate 27 by the screw 42 at the previous location of the cover plate 83 while the cover plate is reattached to the squeeze plate by the screw 90 at the previous location of the basin former. In this way, the position of the basin former may be quickly changed without need of disconnecting and then re-connecting the sand discharge tube 47 and the air line 63. In appropriate cases, the modular construction of the squeeze plate enables two or more basin formers to be attached to the squeeze plate if a particular mold 11 requires multiple pouring basins.

I claim:

1. In a molding machine, the combination of, a pattern plate having an upwardly extending sprue former, a cope flask located above said pattern plate, a squeeze head located above said cope flask, said pattern plate and said cope flask being adapted to be closed vertically relative to said squeeze head to pack sand in said cope flask against said pattern plate and thereby form a cope mold having a sprue, a basin former extending downwardly from said squeeze head for forming a pouring basin in the upper side of said mold adjacent the upper end of said sprue, said basin former having a vertically extending passage therethrough, a sand discharge tube communicating with the upper end of said passage, a tubular liner disposed within said passage and communicating with said discharge tube, said liner having a vertically extending side wall and having a bottom wall formed with a hole for telescopically receiving said sprue former during closing of said cope flask, an opening formed through said side wall and communicating with the interior of said liner above said bottom wall, and means for admitting a flow of pressurized air through said opening and into the interior of said liner thereby to blow loose sand from said liner and into said discharge tube.

2. A molding machine as defined in claim 1 in which the bottom wall of said liner includes an upper surface which slopes upwardly away from said opening so as to cause said pressurized air to sweep sand away from the corner at the junction of said side and bottom walls.

3. A molding machine as defined in claim 1 in which said basin former includes an upper end clamped against said squeeze head, said passage including a channel located outside of said liner and having upper and lower end portions, the lower end portion of said channel communicating with the opening in said liner, said flow admitting means comprising said channel and further comprising a port formed in said squeeze head and communicating with the upper end portion of said channel, and a source of pressurized air communicating with said port.

4. A molding machine as defined in claim 3 in which said basin former includes an upper chamber surrounding said liner, and located immediately adjacent said squeeze head, said chamber communicating with said port, and a series of angularly spaced passageways formed in the upper end of said basin former and leading from said chamber to the outer side of said basin former, pressurized air in said chamber being directed outwardly through said passageways to blow sand away from said pouring basin and outwardly across the upper side of said mold.

5. In a molding machine, the combination of, a pattern plate having an upwardly extending sprue former, a cope flask located above said pattern plate for holding a charge of sand, a squeeze head located above said cope flask and having a generally horizontal bottom squeeze plate, said pattern plate and said cope flask being adapted to be closed vertically relative to said squeeze plate to pack sand in said cope flask against said pattern plate and thereby form a cope mold having a sprue, a hole formed vertically through said squeeze plate, a tubular basin former attached removably to and extending downwardly from said squeeze plate in substantial alignment with said hole for forming a pouring basin in the upper side of said mold adjacent the upper side of said sprue, a sand discharge tube extending upwardly from said squeeze plate and communicating with said hole, a tubular liner disposed within said basin former and communicating with said discharge tube, said liner having a vertically extending side wall and having a bottom wall formed with a hole for telescopically receiving said sprue former during closing of said cope flask, an opening formed through said side wall above said bottom wall, an air port formed in said squeeze plate adjacent the hole in the squeeze plate, a source of pressurized air communicating with said air port, and passage means between said basin former and said liner for directing pressurized air from said air port and into said liner by way of said opening thereby to cause said pressurized air to blow loose sand upwardly through said liner and into said discharge tube.

6. A molding machine as defined in claim 5 further including additional holes formed vertically through said squeeze plate and spaced horizontally from one another, additional air ports formed in said squeeze plate adjacent said additional holes and adapted to communicate with said source of pressurized air, and a cover plate removably attached to said squeeze plate near each additional hole and having means for closing off such hole and for sealing the air port adjacent thereto.

7. In a molding machine, the combination of, a pattern plate having an upwardly extending sprue former, a cope flask located above said pattern plate, a squeeze head located above said cope flask, said pattern plate and said cope flask being adapted to be closed vertically relative to said squeeze head to pack sand in said cope flask against said pattern plate and thereby form a cope mold having a sprue, said squeeze head having a plurality of horizontally spaced holes formed vertically therethrough, sand discharge tubes attached to said squeeze head and extending upwardly from said holes, horizontally spaced air ports formed in said squeeze head and opening downwardly therefrom, there being one air port associated with each of said holes, a source of pressurized air communicating with each of said air ports, a tubular basin former removably attached to said squeeze head and extending downwardly from one of said holes, said basin former being aligned vertically with said sprue former and telescopically receiving said sprue former to form a pouring basin in the upper side of said mold adjacent the upper end of said sprue during closing of said cope flask, means for admitting a flow of pressurized air into said basin former from the air port associated with said one hole whereby said pressurized air blows sand upwardly out of said basin former and through the discharge tube extending upwardly from said one hole, and cover plates removably attached to said squeeze head adjacent other ones of said holes and having means for closing off such holes and the air ports associated therewith.

8. A molding machine as defined in claim 7 in which a vertically extending passage is formed through said basin former and communicates with the discharge tube associated with said one hole, a tubular liner disposed in said passage, said liner having a vertically extending side wall and having a bottom wall formed with a hole for telescopically receiving said sprue former, said flow admitting means comprising an opening formed through said side wall and communicating with the interior of said liner above said bottom wall, said opening also communicating with the air port associated with said one hole.

* * * * *